US008198961B2

(12) United States Patent
Liao

(10) Patent No.: US 8,198,961 B2
(45) Date of Patent: Jun. 12, 2012

(54) MICROWAVE FILTER BASED ON A NOVEL COMBINATION OF SINGLE-MODE AND DUAL-MODE CAVITIES

(75) Inventor: Ching-Ku Liao, Taichung (TW)

(73) Assignee: Gemtek Technology Co., Ltd., Hsinchu County (TW)

( * ) Notice: Subject to any disclaimer, the term of this patent is extended or adjusted under 35 U.S.C. 154(b) by 825 days.

(21) Appl. No.: 12/342,573

(22) Filed: Dec. 23, 2008

(65) Prior Publication Data

US 2010/0156568 A1 Jun. 24, 2010

(51) Int. Cl.
*H01P 1/209* (2006.01)

(52) U.S. Cl. ..... 333/212; 333/230

(58) Field of Classification Search ..... 333/202, 333/208, 209, 212, 219, 227, 230, 231
See application file for complete search history.

(56) References Cited

U.S. PATENT DOCUMENTS 6,538,535 B2 3/2003 Guglielmi et al.

OTHER PUBLICATIONS

Marco Guglielmi, Pierre Jarry, Eric Kerherve, Olivier Roquebrun and Dietmar Schmitt; A New Family of All-Inductive Dual-Mode Filters; IEEE Transactions on Microwave Theory and Techniques, vol. 49, No. 10, Oct. 2001, pp. 1764-1769.

Uwe Rosenberg and Smain Amari; Novel Design Possibilities for Dual-Mode Filters Without Intracavity Couplings; IEEE Microwave and Wireless Components Letters, vol. 12, No. 8, Aug. 2002, pp. 296-298.

Ching-Ku Liao, Pei-Ling Chi, and Chi-Yang Chang; Microstrip Realization of Generalized Chebyshev Filters with Box-Like Coupling Schemes; IEEE Transactions on Microwave Theory and Techniques, vol. 55, No. 1, Jan. 2007, pp. 147-153.

Smain Amari, and Uwe Rosenberg, New Building Blocks for Modular Design of Elliptic and Self-Equalized Filters, IEEE Transactions on Microwave Theory and Techniques, vol. 52, No. 2, Feb. 2004, pp. 721-736.

*Primary Examiner* — Benny Lee
*Assistant Examiner* — Gerald Stevens
(74) *Attorney, Agent, or Firm* — Rosenberg, Klein & Lee

(57) ABSTRACT

A microwave filter based on the combination of dual-mode and single-mode cavities. The single-mode cavity symmetrically extends from the dual-mode cavity with respect to the symmetric reference plane to form the so called extended doublet network. The microwave filter in extended-doublet configuration exhibit high frequency selectivity since it has a pair of finite frequency transmission zeros on the upper and lower stopband. The design concept can also be applied to build higher order filters.

10 Claims, 8 Drawing Sheets

MICROWAVE FILTER BASED ON A NOVEL COMBINATION OF SINGLE-MODE AND DUAL-MODE CAVITIES

FIELD OF THE INVENTION

The present invention is related to a microwave filter, and more particular to a microwave filter based on single-mode and dual-mode cavities.

BACKGROUND OF THE INVENTION

Please refer to document 1 (U.S. Pat. No. 6,538,535 B2) and document 2 (Marco Guglielmi, Pierre Jarry, Eric Kerherve, Oliver Roquebrun, and Dietmar Schmitt, "A new family of all-inductive dual-mode filters", IEEE trans. On Microwave theory & Tech., vol. 10, October 2001, pp. 1764-1769), the prior art provides a dual-mode waveguide filter 100 as shown in FIG. 1.

The dual-mode waveguide filter 100 has two dual-mode cavities 110, 120 coupled to each other. The dual-mode cavities 110 has an opening 111 for coupling with an input waveguide (not shown), and the dual-mode cavities 120 has an opening 121 for coupling with an output waveguide (not shown).

Instead of using circular or elliptical waveguide which is difficult to manufacture, the dual-mode waveguide filter 100 is designed as a rectangular waveguide with inductive discontinuities. The dual-mode waveguide filter 100 is called the all-inductive dual-mode filter. In the design of the all-inductive dual-mode filter, resonant frequencies of modes and coupling strengths between modes are controlled by the size of cavities and irises between cavities and input/output waveguide. The all-inductive dual-mode filter presents the advantage of being simple to design, simulate, and manufacture.

In addition, the all-inductive dual-mode filter exhibits high frequency selectivity since finite frequency transmission zeros can be generated inherently. The disadvantage of the all-inductive filters in documents 1 and 2 is that lots of physical parameters need to be carefully designed and adjusted since coupling topologies of filters are really complex ("Rosenberg, U. Amari, S., "Novel design possibilities for dual-mode filters without intracavity couplings", Microwave and Wireless Components Letters, August 2002, pp. 296-298", hereinafter being simplified by "document 3").

SUMMARY OF THE INVENTION

The object of the present invention is to provide a microwave filter to take the full advantage of all-inductive dual-mode filters. In this invention, to simplify the coupling topology of filters, single-mode and dual-mode cavities are used simultaneously to build a new class of filters.

Accordingly, an objective of the present invention is to provide a microwave filter based on single-mode and dual-mode cavities for filtering an electromagnetic wave transmitted from an input waveguide to an output waveguide. The microwave filter comprises a dual-mode cavity and a single-mode cavity. The dual-mode cavity is symmetric to a symmetric reference plane, and has a first side and a second side opposite to the first side with respect to the symmetric reference plane. The input waveguide couples to the first side and the output waveguide couples to the second side along an extension axis. The extension axis is perpendicular to the symmetric reference plane and has an offset to a central reference plane of the dual-mode cavity.

The single-mode cavity extends from the dual-mode cavity with respect to the symmetric reference plane. The single-mode cavity is physically symmetric to the symmetric plane. The single-mode cavity connects the dual-mode cavity with a connecting passage which can effectively control the coupling strength between cavities.

Moreover, the dual-mode cavity operates in two distinct transverse electric (TE) modes and the single-mode cavity operates in one TE mode, and the field distribution of TE modes in the dual-mode cavity and the single-mode cavity is symmetric with respect to the symmetric reference plane.

The mode in single-mode cavity only couples to one of the two modes in the dual-mode cavity, which results in the so-called extended doublet configuration.

In conclusion, the microwave filter of the present invention is physically symmetric. That is only half of physical dimension of the microwave filter need to be designed for a prescribed response, which makes the microwave filter easier to design and manufacture when compared to the prior art in FIG. 1. Concerning with electrical performance, the proposed microwave filter is in extended-doublet configuration and can generate a pair of finite transmission zeros on the upper and lower stopband, which makes it different from the prior art where two dual-mode cavities are needed to generate and control two finite transmission zeros.

Undoubtedly, the objective of the present invention will become obvious to those of ordinary skill in the art after reading the following detailed description of the preferred embodiment, which is illustrated in the various figures and drawings.

BRIEF DESCRIPTION OF THE DRAWINGS

The present invention can be fully understood from the following detailed description and preferred embodiment with reference to the accompanying drawings, in which.

DETAILED DESCRIPTION OF THE PREFERRED EMBODIMENTS

Figure 1:
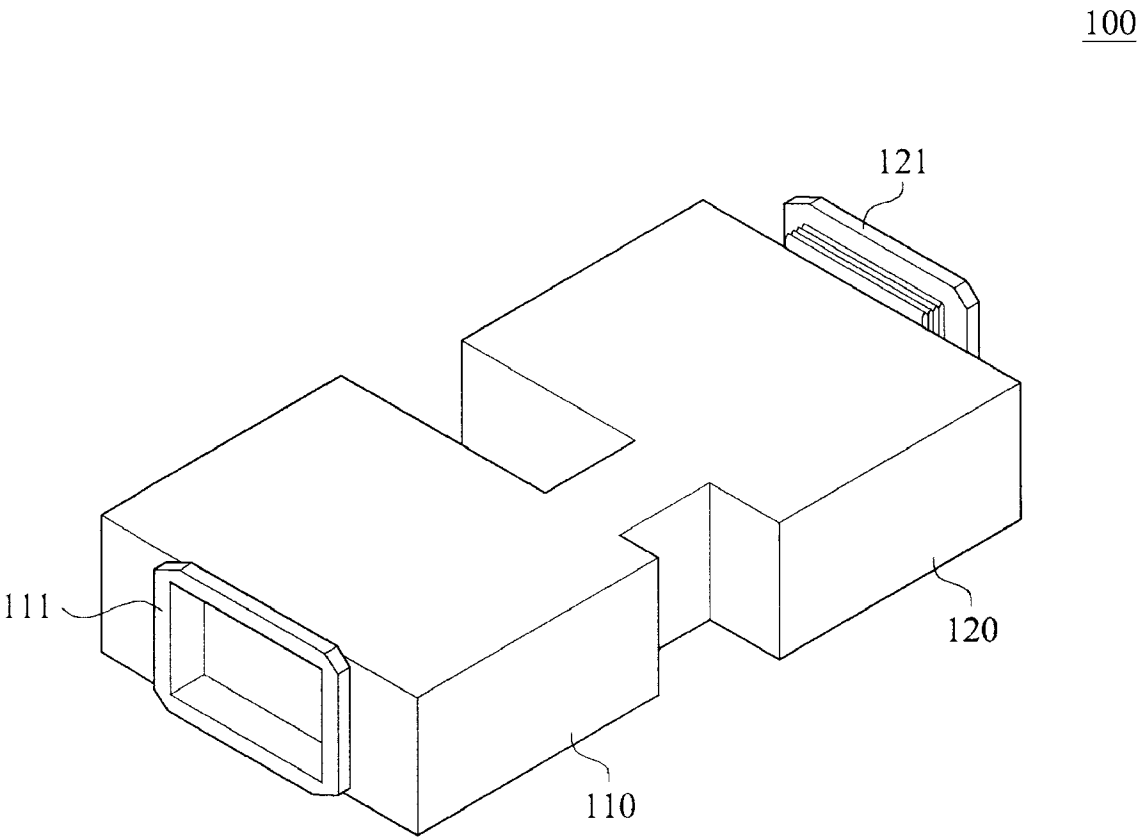
FIG.1 (Prior Art)
FIG. 1 is a perspective view that illustrates a dual-mode waveguide filter of prior art.
Figure 2:
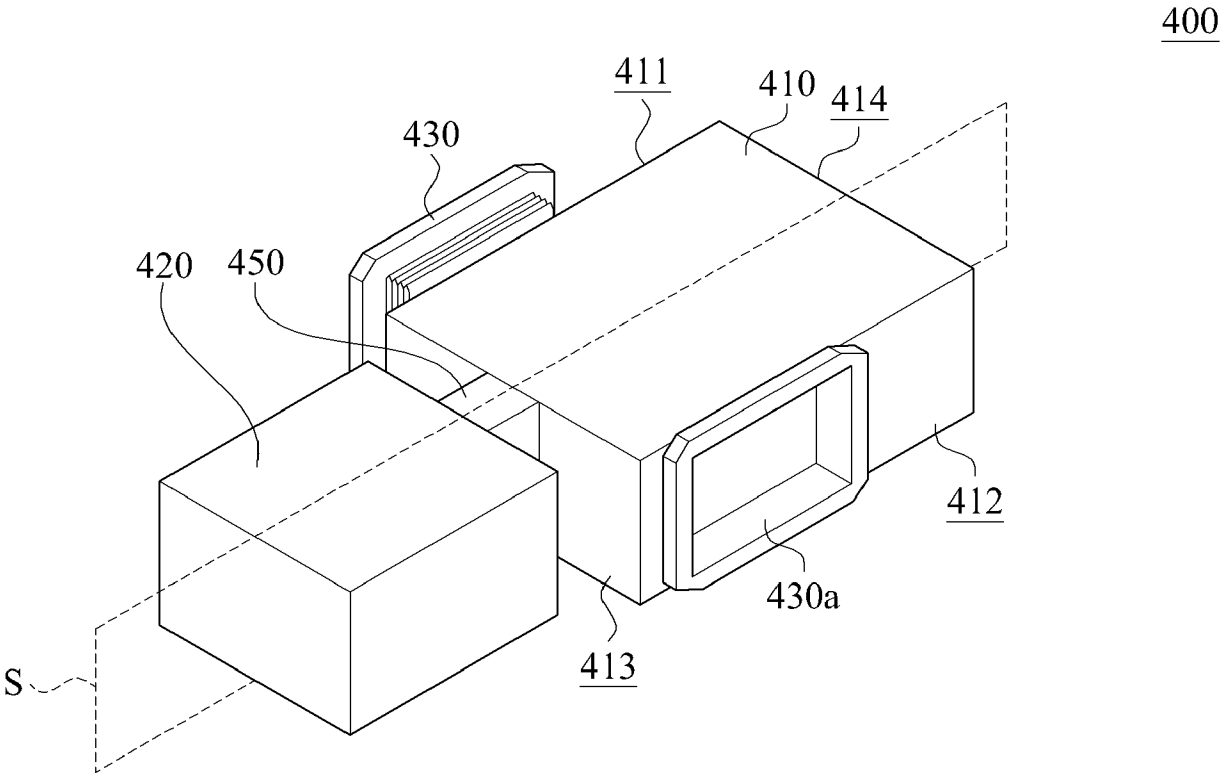
FIG. 2 is a perspective view that illustrates a microwave filter according to the first embodiment of the present invention.
Figure 3:
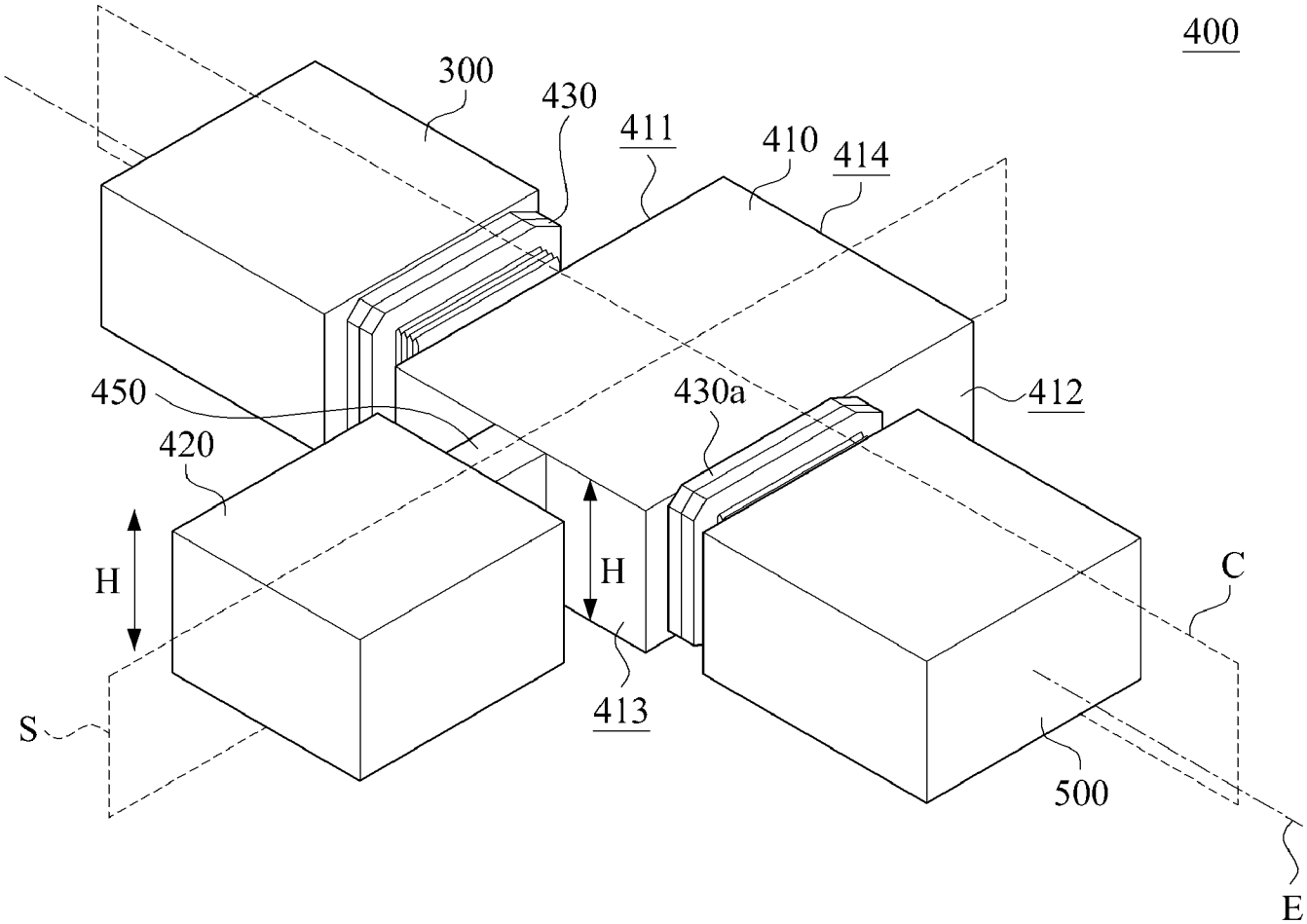
FIG. 3 is a perspective view that illustrates the microwave filter coupling to an input waveguide and an output waveguide.

Please refer to FIG. 2, which is a perspective view illustrating the basic physical configuration of a microwave filter 400 according to a first embodiment of the present invention. FIG. 3 illustrates the microwave filter 400 coupling to an input waveguide 300 and an output waveguide 500. The input waveguide 300 and output waveguide 500 are WR75.

The microwave filter 400 based on single-mode and dual-mode cavities is used for filtering an electromagnetic wave transmitted from the input waveguide 300 to the output waveguide 500. The microwave filter 400 can be a band-pass filter, so that the microwave filter 400 allows certain frequencies of the electromagnetic wave to be transmitted to the output waveguide 500 while rejecting the remaining frequencies.

The microwave filter 400 comprises a dual-mode cavity 410, a single-mode cavity 420, and a plurality of binding passages 430, 430*a*.

The dual-mode cavity 410 has a rectangular shape and is symmetric to a symmetric reference plane S. The dual-mode cavity 410 has a first side 411, a second side 412, a third side 413, and a fourth side 414. The second side 412 is opposite to the first side 411 with respect to the symmetric reference plane S. The third side 413 is opposite to the fourth side 414 with respect to a central reference plane C. The central reference plane C is perpendicular to the symmetric reference plane S.

The input waveguide 300 couples to the first side 411 and the output waveguide 500 couples to the second side 412 along an extension axis E. The extension axis E is perpendicular to the symmetric reference plane S and has an offset to the central reference plane C of the dual-mode cavity 410.

The binding passage 430 symmetrically extends from the first side 411 with respect to the extension axis E and connects the input waveguide 300 with the dual-mode cavity 410 along the extension axis E. The binding passage 430*a* symmetrically extends from the second side 412 with respect to the extension axis E and connects the output waveguide 500 with the dual-mode cavity 410 along the extension axis E.

The single-mode cavity 420 symmetrically extends from the dual-mode cavity 410 with respect to the symmetric reference plane S. The single-mode cavity 420 connects the dual-mode cavity 410 with a connecting passage 450 which can effectively control the coupling strength between cavities. In this embodiment, the single-mode cavity 420 is in rectangular shape, and the connecting passage 450 is a hollow rectangular passage. The connecting passage 450 extends from the third side 413 and connects the single-mode cavity 420 with the dual-mode cavity 410.

In this embodiment, the length L1 of the binding passage 430, 430*a* is 3.000 mm, and the width W1 is 10.740 mm. The length L2 of the dual-mode cavity 410 is 29.076 mm, and the width W2 is 29.501 mm. The length L3 of the connecting passage 450 is 3.000 mm, and the width W3 is 6.700 mm. The length L4 of the single-mode cavity 421 is 15.380 mm, and the width W4 is 26.125 mm. The offset between the central reference plane C and the extension axis E is 8.396 mm. The height H of the dual-mode cavity 410, the connecting passage 450, and the single-mode cavity 421 is 9.525 mm.

The dual-mode cavity 410 operates in two TE modes and the single-mode cavity 421 operates in one TE mode. The field distributions of TE modes are symmetric with respect to symmetric reference plane S. The two TE modes operated in the dual-mode cavity 410 could be $TE_{201}$ (Transverse Electric, TE) mode and $TE_{102}$ mode. With respect to a symmetric reference plane S, the $TE_{201}$ mode exhibits even symmetry while the $TE_{102}$ mode exhibits odd symmetry.

Figure 4:
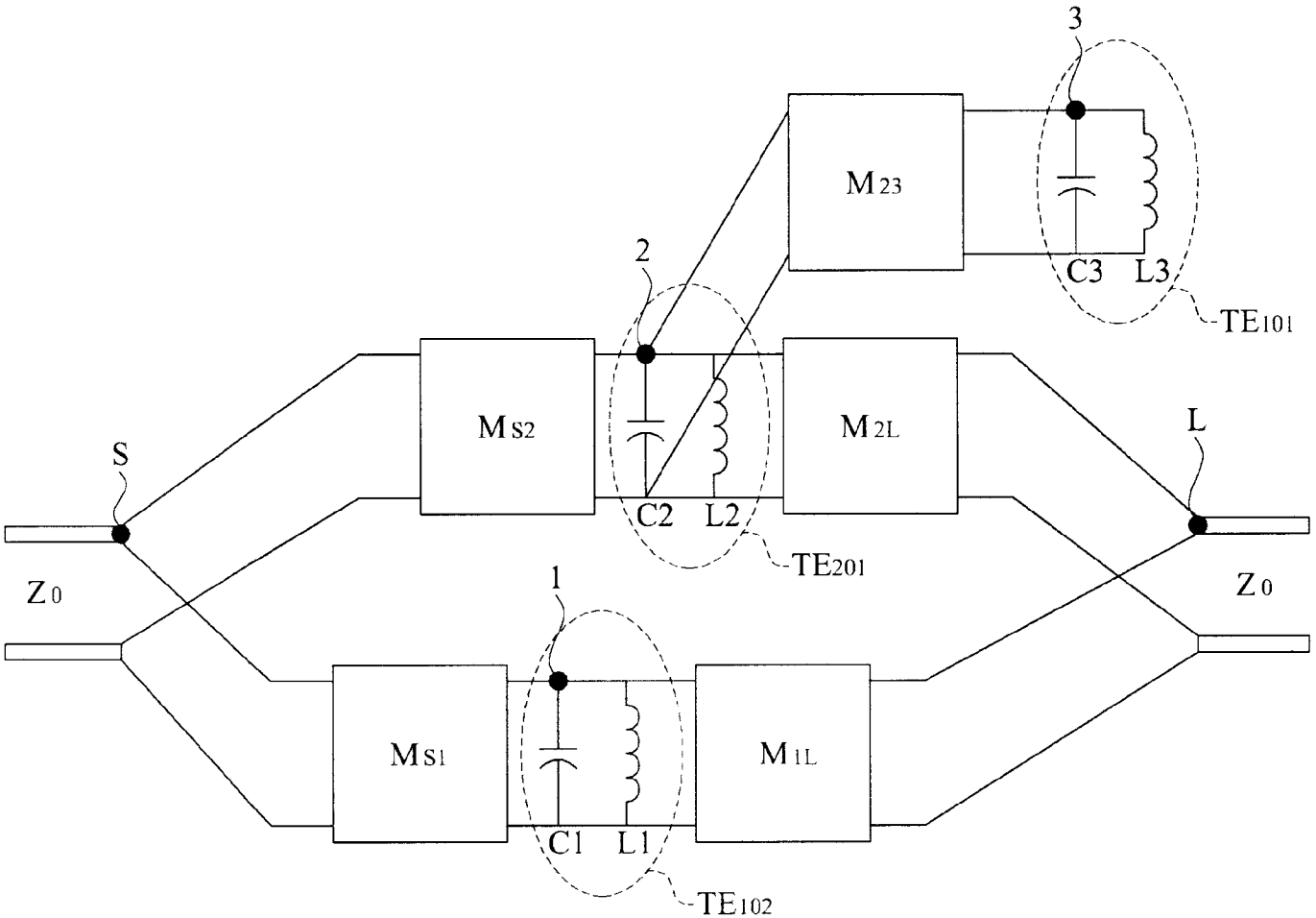
FIG. 4 is an equivalent circuit diagram that illustrates equivalent circuit of the microwave filter in FIG. 3.

To let the TE mode in the single-mode cavity 421 only couples to one of the two TE modes in the dual-mode cavity 410, the TE mode in the single-mode cavity 421 must exhibits even- or odd-symmetry with respect to the symmetric reference plane S. In this embodiment, the TE mode in the single-mode cavity 421 is $TE_{101}$ which exhibits even symmetry. Please refer to FIG. 4, which illustrates an equivalent circuit diagram of the microwave filter. This equivalent circuit is named extended doublet in document 5. If we utilize $TE_{101}$ mode in the single-mode cavity 421, the $TE_{101}$ mode only couples to $TE_{201}$ mode in the dual-mode cavity 410, which results in the electrical network in the normalized domain as shown in FIG. 4. The $M_{ij}$s in FIG. 4 are ideal admittance inverter and the pair of $C_i$ and $L_i$ stand for resonant modes. The nodes S, 1, 2, 3, and L are used to indicate the nodes in the circuit. The configuration of the circuit is called an extended-doublet in the art.

Please refer to FIG. 4, which illustrates an equivalent circuit diagram of the microwave filter. This equivalent circuit is named extended doublet in document 5. If we utilize $TE_{101}$ mode in the single-mode cavity 421, the $TE_{101}$ mode only couples to $TE_{201}$ mode in the dual-mode cavity 410, which results in the electrical network in the normalized domain as shown in FIG. 4. The $M_{ij}$s in FIG. 4 are ideal admittance inverter. In the normalized domain, the finite frequency transmission zeros can be expressed with the following equation $$\Omega_z^2 = \frac{M_{S1}^2 M_{23}^2}{M_{S1}^2 - M_{S2}^2} \tag{1}$$

where $\Omega_z$ is the finite frequency transmission zero in the normalized frequency domain.

And real frequency domain are related to normalized frequency domain by the equation $$\Omega = \frac{f_0}{BW}\left(\frac{f}{f_0} - \frac{f_0}{f}\right) \tag{2}$$

where $f_0$ and BW are center frequency and bandwidth of filter, respectively.

Given a prescribed response, $M_{ij}$s shown in FIG. 4 can be synthesized by the method given in document 3.

The topology of the electrical network is named "extended doublet", and has been realized with different technique in document 4 (Ching-Ku Liao, Pei-Ling Chi, and Chi-Yang Change, "Microstrip realization of generalized Chebyshec filters with box-like coupling schemes", IEEE trans. On Microwave theory & Tech., January 2007, pp. 147-153) and document 5 (S. Amari and U. Rosenberg, "New building blocks for modular design of elliptic and self-equalized filters", IEEE trans. On Microwave theory & Tech., vol. 52, February 2004, pp. 721-736). However, using the single-mode cavity and dual-mode cavity to realize the extended-doublet configuration is novel.

Figure 6:
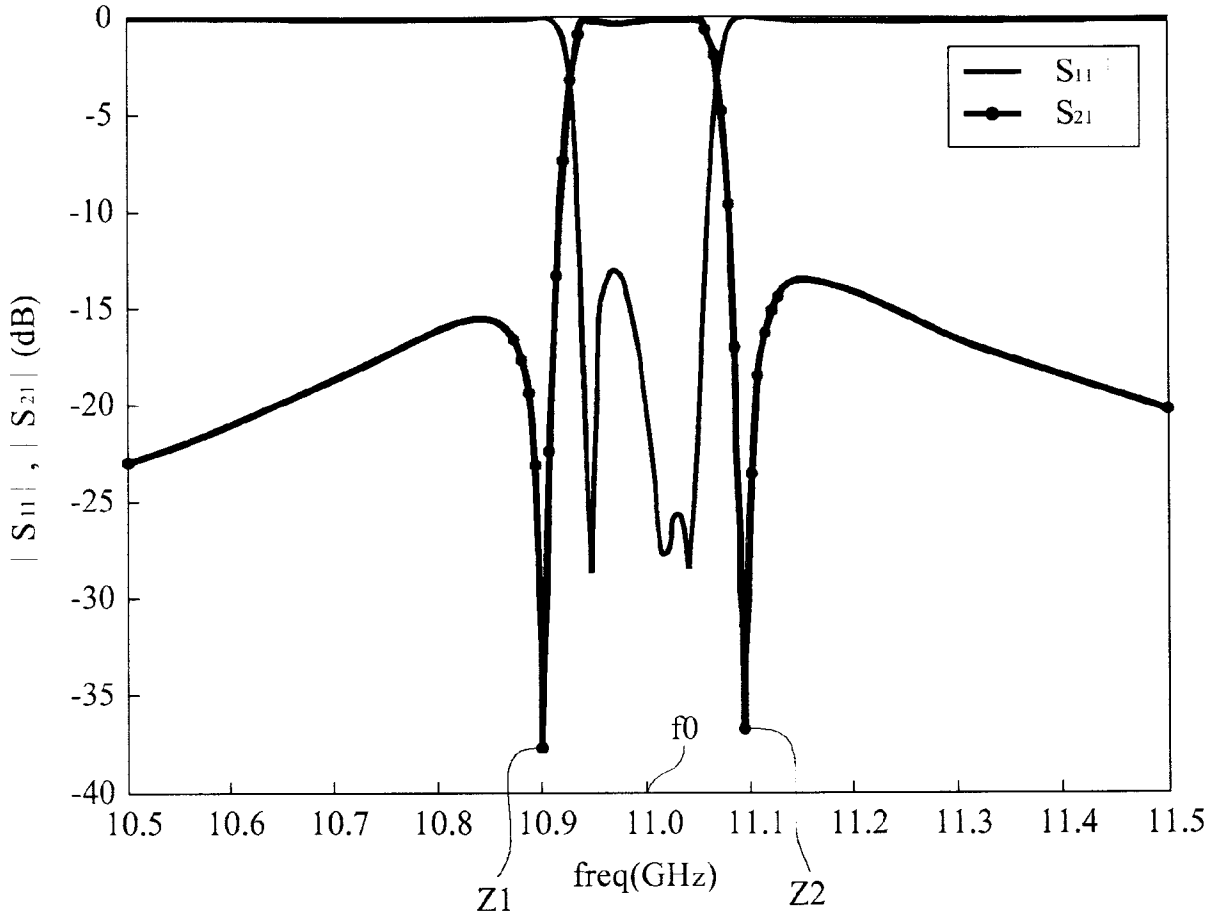
FIG. 6 shows the corresponding return loss and insertion loss response of the filter with given dimension in FIG. 5.

An example is given below to illustrate the feasibility of the microwave filter. Please refer to FIG. 6, which shows the return loss curves S11 and insertion loss curve S21 according to the first embodiment. The microwave filter 400 presents two transmission zeros Z1, Z2 on the upper stopband and lower stopband to improve the frequency selectivity. The center frequency $f_0$ of the filter is 11 GHz and fractional bandwidth is 2%. The initial dimension of the dual-mode cavity 410 can be obtained with the method given in document 1 and document 2, and the initial dimension of the single mode cavity 421 can also be easily obtained with the formula in textbook (Microwave Engineering, $2^{nd}$ edition, David M. Pozar, Wiley).

Figure 5:
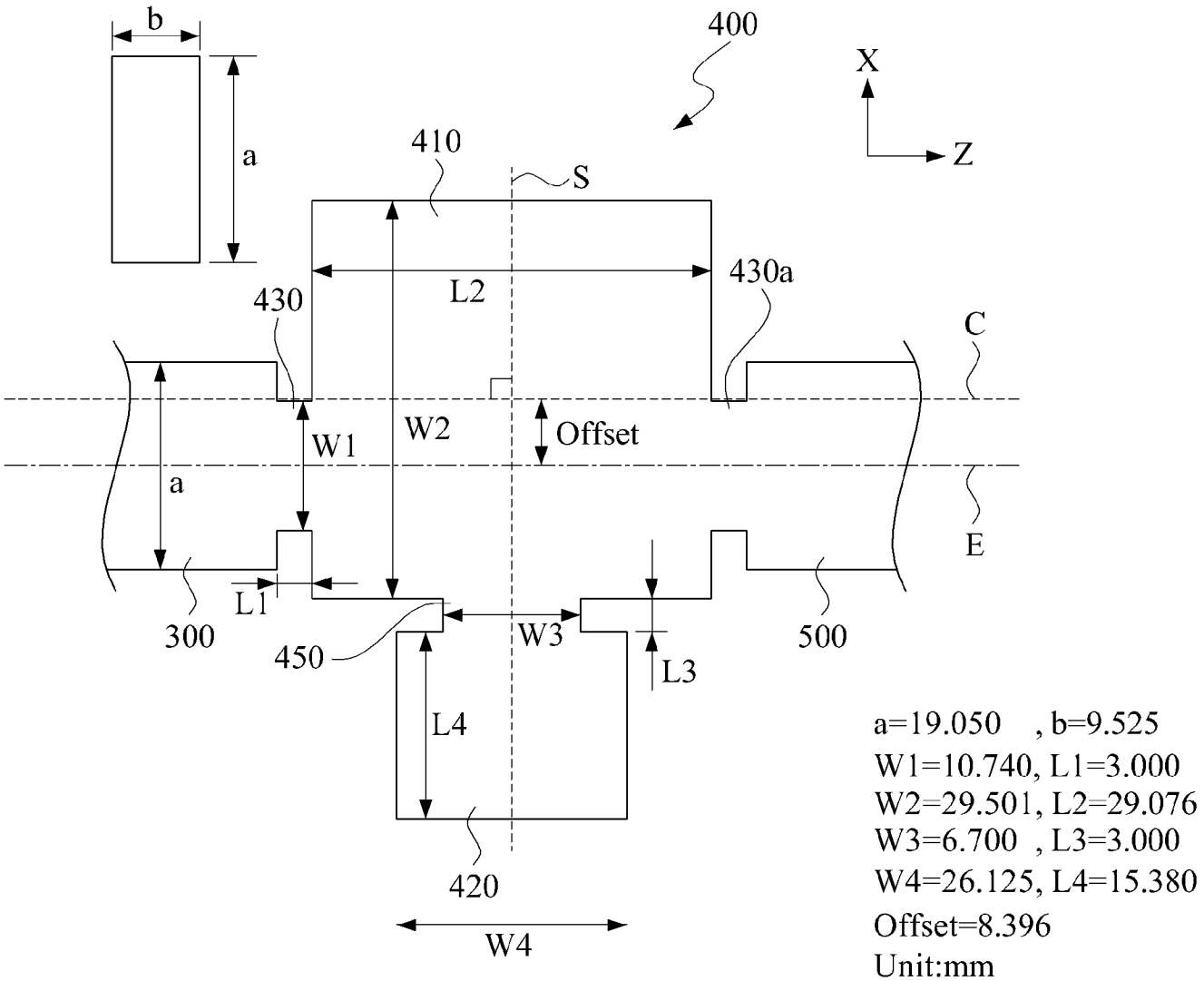
FIG. 5 is the top view of the proposed filter with a given dimension for illustrating the feasibility of the design.

After getting the initial dimension of a filter, optimization procedure need to be invoked to adjust the physical dimension to let the corresponding electrical performance matched with a prescribed response. The optimized dimension is given in FIG. 5 with corresponding response simulated by Ansoft HFSS in FIG. 6.

Figure 7:
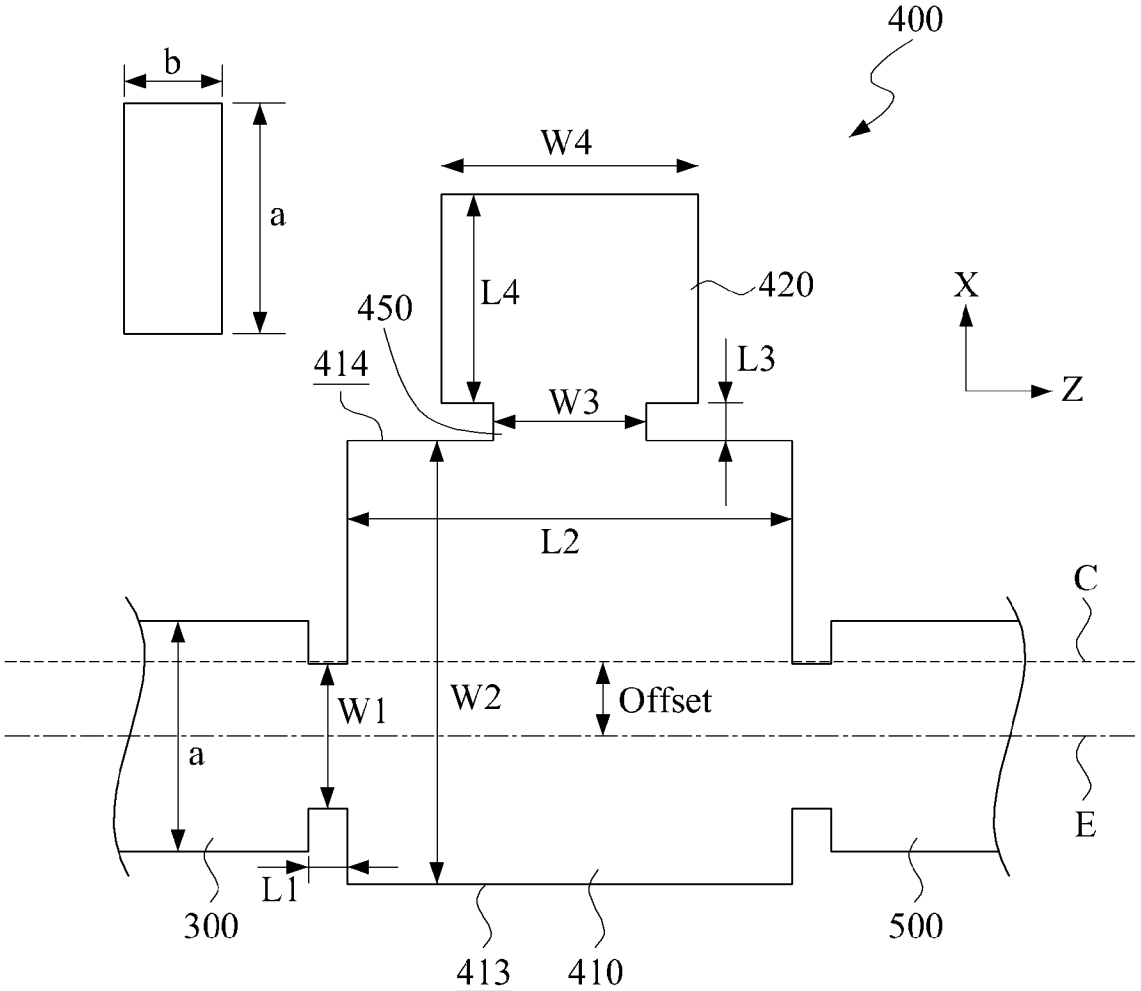
FIG. 7 is a cross-sectional schematic diagram according to the second embodiment of the present invention.

In FIG. 7, the single-mode cavity 420 is flipped up to the fourth side 414 of dual-mode cavity 410. The implementation shown in FIG. 5 and FIG. 7 exhibit nearly identical response. Thus, one can choose either the configuration in FIG. 5 or the one in FIG. 7 depending on application.

Figure 8:
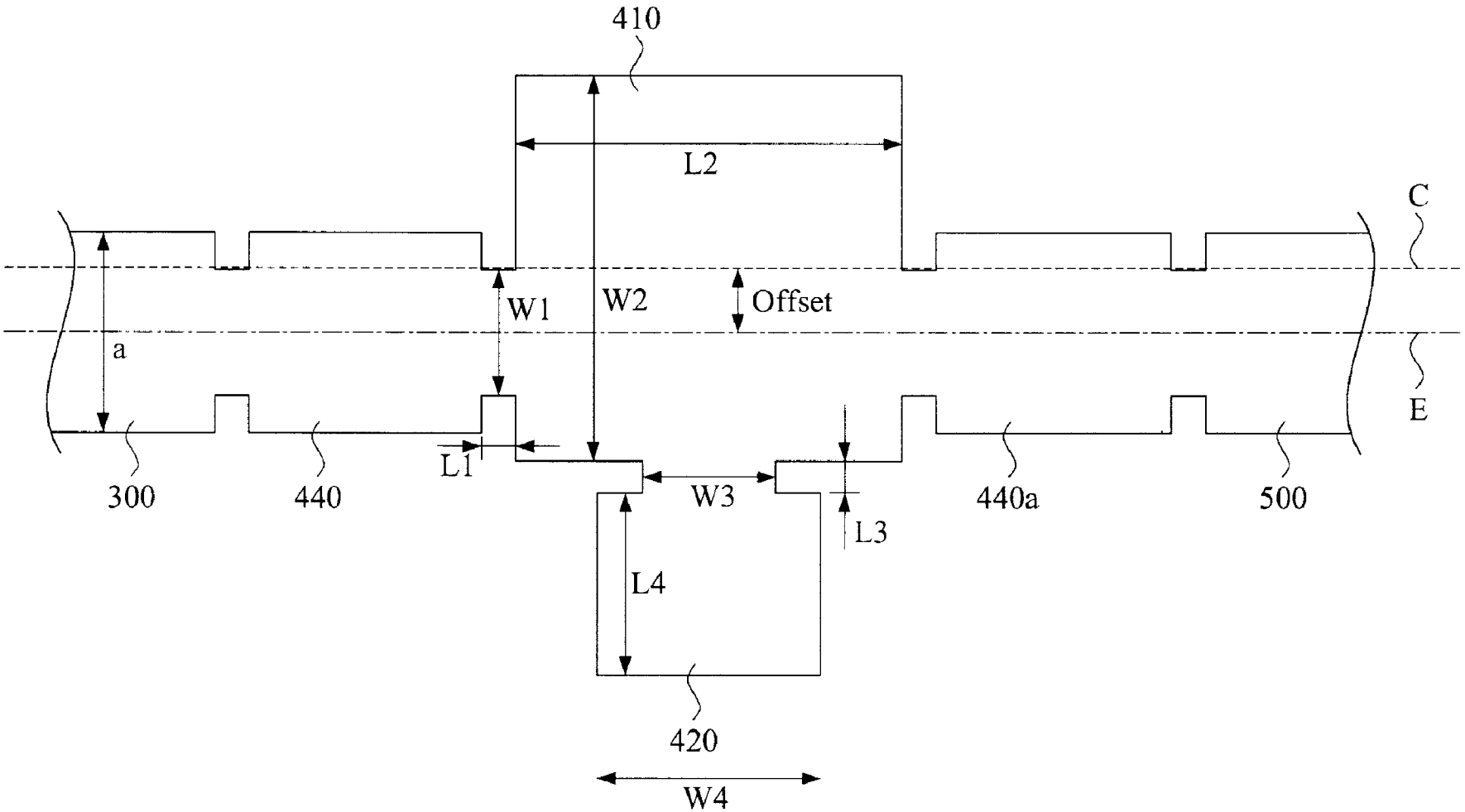
FIG. 8 is a cross-sectional schematic diagram according to the third embodiment of the present invention.

The combination of the dual-mode cavity 410 and single-mode cavity 420, which extends from the dual-mode cavity 410 along the symmetric reference plane S, can be utilized to design filter with higher order. For instance, the $5^{th}$ order filter in FIG. 8 could be implemented. A first connecting cavity 440 connects with the input waveguide 300 and the dual-mode cavity 410 along the extension axis E. A second connecting cavity 440*a* connects with the output waveguide 500 and the dual-mode cavity 410 along the extension axis E. The connecting cavity 440 and the connecting cavity 440*a* is symmetric with respect to the symmetric reference plane S. That is we can treat the basic combination of a dual-mode cavity 410 and a single-mode cavity 420 as a building block which can generate a pair of finite transmission zeros, and this configuration can be utilized in filter with order 3, 5, 7 . . . 2n+1.

In the conclusion, the microwave filter 400 of the present invention generates two finite frequency transmission zeros which improve the filter's selectivity. The microwave filter 400 of the present invention is physically symmetric. Therefore, there is only half of physical dimension of the microwave filter 400 need to be designed for a prescribed response, which makes the microwave filter 400 easier to design and manufacture. Concerning with electrical performance, the microwave filter 400 can generate a pair of finite transmission zeros on the upper and lower stopband, which makes it different from the prior art where two dual-mode cavities are needed to generate and control two finite transmission zeros.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A microwave filter based on the combination of single-mode and dual-mode cavities for filtering an electromagnetic wave transmitted from an input waveguide to an output waveguide, the microwave filter comprising:

the dual-mode cavity being physically symmetric to a symmetric reference plane, and having a first side and a second side which is opposite to the first side with respect to the symmetric reference plane, the input waveguide coupled to the first side and the output waveguide coupled to the second side along an extension axis, the extension axis being perpendicular to the symmetric reference plane and having an offset to a central reference plane of the dual-mode cavity; and the single-mode cavity connected to the dual-mode cavity along the direction of the symmetric reference plane.

2. The microwave filter according to claim 1, wherein the dual-mode cavity is in rectangular shape and operating in two distinct transversal electric (TE) modes.

3. The microwave filter according to claim 1, wherein the central reference plane is perpendicular to the symmetric reference plane.

4. The microwave filter according to claim 1, wherein the single-mode cavity is in rectangular shape and operating in one TE mode which is coupled to one of the two modes in dual-mode cavity.

5. The microwave filter according to claim 1, wherein the microwave filter is arranged in an extended-doublet configuration.

6. The microwave filter according to claim 1, wherein the height of the dual-mode cavity and the height of the single-mode cavity are the same.

7. The microwave filter according to claim 1, wherein the two modes operated in the dual-mode cavity are $TE_{201}$ mode and $TE_{102}$ mode.

8. The microwave filter according to claim 1, wherein the mode operated in the single-mode cavity is $TE_{101}$ mode.

9. The microwave filter according to claim 1, further comprising a first connecting cavity connecting with the input waveguide and the dual-mode cavity along the extension axis, and a second connecting cavity connecting with the output waveguide and the dual-mode cavity along the extension axis.

10. The microwave filter according to claim 1, wherein the single-mode cavity connects the dual-mode cavity with a connecting passage which effectively controls the coupling strength between the single-mode cavity and the dual-mode cavity.

* * * * *